United States Patent [19]

Mahoney et al.

[11] 3,987,723

[45] Oct. 26, 1976

[54] PHASE ADJUSTMENT MECHANISM FOR USE WITH A MAGNETIC READ STATION OF A BAND PRINTER

[75] Inventors: Frank A. Mahoney, Wyncote; Ronald W. F. Hutley, Lansdale, both of Pa.

[73] Assignee: Sperry Rand Corporation, New York, N.Y.

[22] Filed: Mar. 27, 1975

[21] Appl. No.: 562,701

[52] U.S. Cl. ..... 101/111; 101/93.14

[51] Int. Cl.[2] ..... B41J 1/20

[58] Field of Search 101/111, 109, 110, 93.29–93.34, 101/93.14, 181, 248

[56] References Cited

UNITED STATES PATENTS

| | | | |
|---|---|---|---|
| 3,117,514 | 1/1964 | Doersam | 101/93.29 |
| 3,259,059 | 7/1966 | Doersam | 101/93.29 |
| 3,559,568 | 2/1971 | Stanley | 101/248 X |
| 3,605,610 | 9/1971 | McDowell et al. | 101/111 X |
| 3,672,297 | 6/1972 | Berglund | 101/111 X |
| 3,805,698 | 4/1974 | Bowers et al. | 101/111 |

OTHER PUBLICATIONS

IBM Technical Disclosure Bulletin, Hall, vol. 15, No. 3, Aug. 1972, p. 906.

*Primary Examiner*—Edward M. Coven
*Attorney, Agent, or Firm*—William E. Cleaver

[57] ABSTRACT

The present device is a rotatable support means on which there is mounted the magnetic read heads of a read station which is employed to sense timing marks on a type font band of a band printer system. The support means is rotatable along the path of the type font band and the rotation thereof is effected by two eccentric members, one of which accomplishes a coarse adjustment and the second of which accomplishes a fine adjustment. The variation of the location of the magnetic read station permits images which are being printed on a record to be laterally moved as between one printed line and the following printed line or lines and this shifting of the images horizontally can be accomplished while the record is being printed.

3 Claims, 7 Drawing Figures

PHASE ADJUSTMENT MECHANISM FOR USE WITH A MAGNETIC READ STATION OF A BAND PRINTER

BACKGROUND

One form of an impact printing device employs the use of a flexible endless metallic band having formed thereon a plurality of alpha-numeric characters or other forms of type characters, a plurality of timing marks and an initiating timing mark for each complete set of said characters. Typically, the type band is continuously rotated about a pair of pulleys and the type characters are moved past print positions, behind a record medium upon which printing is to be effected. Individual type hammers are usually provided for each print position or each column of the record. As any one of the type characters approaches the column in which it is to be printed, an electrical signal causes the type hammer, which is positioned opposite that column, to be moved toward the type character on the band. Said movement drives the record medium, as well as an inked ribbon, against the type font to transfer the image thereof onto the record medium.

In order to energize the proper print hammer, at the correct time, there must be some means for indicating the location of the various type characters on the type band at said proper times. Prior art printers have provided a series of timing marks on the print band and a font mark or initiating mark for each of the plurality of complete sets of characters or fonts on the band. In the prior art, the timing marks are spaced at a known distance from each other and in a known relationship to the type characters so that when the timing marks are detected, the resultant signals can be used in conjunction with certain logic circuitry to determine what character is at what position and accordingly actuate the proper print hammers.

While techniques for determining the proper position on the type font with respect to the column on the record medium and the print hammer are known, very little attention has been focused in the prior art on the need for changing the relationship between the read station and the timing marks for the purpose of shifting sideways, or laterally, the characters of a printed line. In particular, when the thickness of a record medium is changed, the amount of time required for the print hammer to impact the type font on the type band changes and accordingly the position of the printed image changes with respect to the column location on the record medium. The present system provides a means for readily effecting a lateral shift of the printed image to accommodate a change in the thickness of paper or simply to accommodate a need for a shift of the printed record which such need may arise for instance because of the position of the paper or record as it is carried on the paper tractors.

SUMMARY

The present device in the preferred embodiment is a "pie-shaped" plate which fits over the pulley shaft of the driving pulley and which is partially rotatable therearound. This plate is secured to the housing of a type band cartridge at one end and it is coupled through a pair of eccentric members to an adjustment knob which is disposed external to the cartridge. In the preferred embodiment there are three magnetic read heads which are mounted on the plate and these read heads are disposed to be in close proximity to the type band so that the timing marks on the type band can be read. The user of the device merely moves the adjustment knob which turns the fine tuning eccentric so that the plate is shifted circumferentially with the type band and therefore the reading heads are shifted circumferentially to provide a new read location. The new read location of course changes the timing signals so that the hammer actuation is either advanced or retarded and accordingly, the printed images are shifted either to the right or to the left. In addition, the present apparatus includes a coarse eccentric member also coupled to said adjustment knob but not operated thereby and said course adjustment is a means for moving the fine adjustment a relatively great distance if the need should arise.

The objects and features of the present invention can well be better understood in view of the description to follow taken in conjunction with the drawings wherein.

Figure 1:
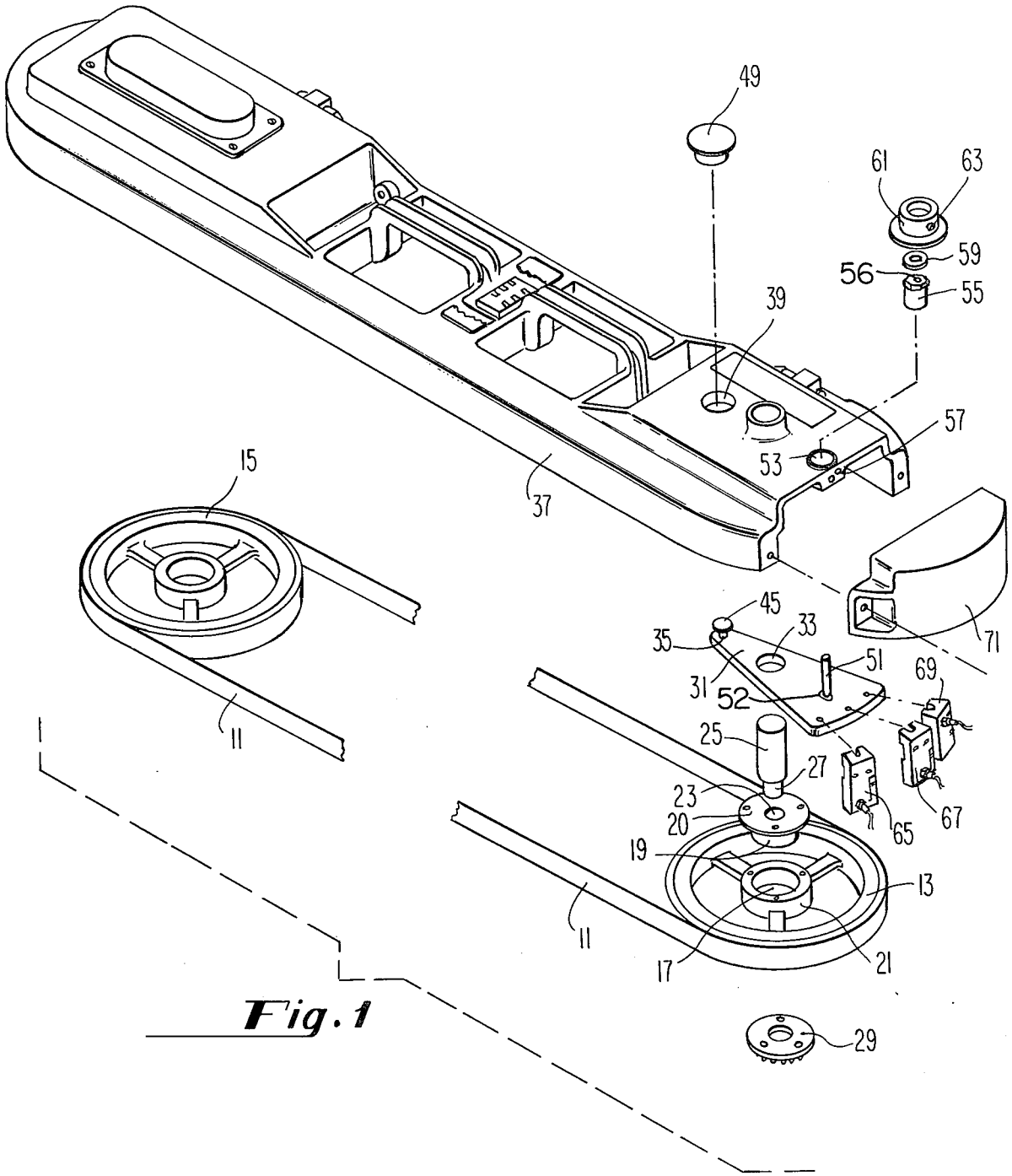
FIG. 1 is an exploded view of an assembly of the type band cartridge with an adjustment plate as part thereof.

Consider FIG. 1 wherein there is shown an exploded view of the type band cartridge for which the present read station adjustment apparatus is a part. A complete description of the assembly of the type band cartridge shown in FIG. 1 has been set out in patent application Ser. No. 562,704 by Frank A. Mahoney et al. which was filed the same day as the present application. Inasmuch as the present invention is directed to only a small portion of the entire assembly that description will not be set forth herein but the foregoing application is included in this application by reference.

In FIG. 1 there is shown a type band 11 upon which no images or timing marks are shown for purposes of simplicity. The type band 11 is shown wrapped around the pulleys 13 and 15. The pulley 13 is the driving pulley and this description will be directed to that end of the assembly although it should be understood that the adjustment apparatus could just as well be located at the other end of the assembly. The driving pulley 13 has a bearing 19 mounted in the aperture 17. The bearing 19 is secured to said driving pulley 13 by the flange 20 which is screwed onto the hub 21 by virtue of the screw holes as shown in the hub 21 and screws not shown. Located in the aperture 23 of the bearing 19 is the lower section 27 of pulley shaft 25. The pulley shaft 25 has a threaded aperture in the bottom thereof and into said threaded aperture there is screwed a holding screw (not shown) with a large flanged top thereon which secures the pulley shaft 25 to the bearing 19. It should be understood that while the pulley shaft 25 is secured to the bearing 19, it is secured in such a way that the bearing 19 can rotate around the lower section 27 so that the pulley 13 is free to rotate. Secured to the bottom surface of the hub 21 is the upper dog clutch section 29. The upper dog clutch section 29 is secured to the hub 21 through the screw holes shown and by virtue of screws not shown. As described in the aforementioned patent application, the upper dog clutch section 29 fits into a receiving dog clutch section which in turn is secured to a driving pulley. Through said dog clutch arrangement, power is transferred to drive the driving pulley 13.

Figure 4:
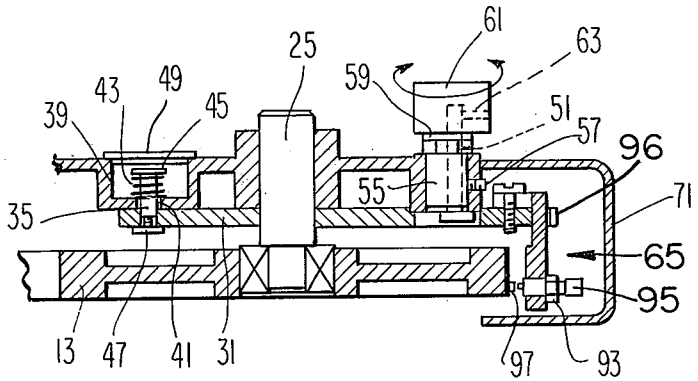
FIG. 4 is a cross section of a side view of the reading station and adjustment plate.

As depicted in FIG. 1 there is a pie-shaped adjustment plate 31 with an aperture 33 therein. The aperture 33 fits over the drive pulley shaft 25 and accordingly the adjustment plate 31 is rotatable around the drive pulley shaft 25. At one end of the drive plate 31 there is located a stud 35. As can be better determined from FIG. 4, the stud 35 has a threaded aperture therein with a holding screw 47 threaded into said threaded aperture. Now returning to FIG. 1, we see that the cartridge casting 37 has a recess 39 formed therein and again examining FIG. 4, we find that the recess 39 has a small aperture 41 formed in the base thereof. The stud 35 fits through the aperture 41 into the recess 39 and a spring 43 which is located under the flange 45 of stud 35 is positioned to keep the stud pulled toward the top of the recess 39. As shown in FIG. 4 the screw 47 which has a flanged head thereon is inserted into the stud 35 so that the flange section of the screw 47 holds the plate 31 secure to the stud 35 and it follows from a study of FIG. 4 that spring 43 then pulls the plate 31 firmly against the lower surface of the "recess" formation 39. If for any reason the plate 31 must be tightened, the flanged screw head 45 is merely tightened down or threaded inward and this action pulls the screw 47 toward the stud 35 thereby tightening the plate 31 against the base of the recess 39. As can be seen in FIG. 1 there is a cap device 49 which fits into the recess 39 to cover the spring loaded stud 35 and which cap is readily removable so that an adjustment can be made if necessary.

Figure 7:
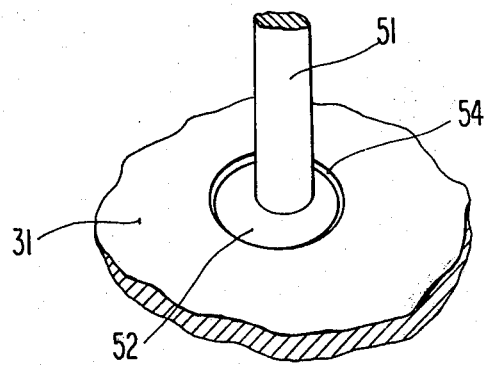
FIG. 7 is an enlarged isometric view of a portion of the adjustment plate of FIGS. 4 and 5.

The plate 31 also has located therein an eccentric shoe 52 which fits into the plate 31 and which is attached to stud 51 as shown in FIG. 7. When the stud 51 is rotated, the shoe 52 moves against a wall of the well 54 thereby moving the plate 31 to the right or to the left in a circumferential excursion with respect to the type band 11 and in a rotational excursion around the pulley drive shaft 25.

It will be noted that the cartridge casting 37 has another aperture 53 into which there is disposed a hexagon eccentric member 55 and the hexagon eccentric member 55 has an aperture 56 therethrough. The eccentric member 55 has a cam portion located off center with respect to the aperture 56. When the eccentric member 55 is rotated, the aperture 56 is moved circumferentially with respect to the center of member 55 or with respect to the center of the aperture 53. The eccentric stud 51 fits through the aperture 56 in the hexagon eccentric 55. As can be better appreciated from FIG. 4 when the hexagon member 55 is rotated within the aperture 53 the stud 51 will have to be moved circumferentially to the right or to the left. The hexagon eccentric member 55 is the means for effecting a coarse adjustment of the adjustment plate 31. The coarse adjustment is usually accomplished at the factory although indeed it may be made by a user at some other place. Once the coarse adjustment has been made, the set screw 57 is put in place and the hexagon eccentric is secured.

Now returning to FIG. 1 we find that after the stud 51 is located in the aperture of the hexagon eccentric 55 there is located on said stud 51 a washer 59 and an adjustment knob 61. The adjustment knob 61 is then secured to the eccentric stud 51 by virtue of a set screw 63. Accordingly, when the user wants to move the adjustment plate 31 either to the right or to the left as shown in the drawing, or to advance or retard the position of the reading heads, when considered with respect to the circumferential excursion of the type band, the user merely turns the knob 61 which rotates the eccentric stud 51 which in turn moves the plate rotationally around the drive shaft 25 therefore placing the reading head assemblies 65, 67 and 69 in new locations.

In FIG. 1 the end cap 71 is located and secured to the cartridge casting 37 to cover the read station and is readily removable therefrom the casting 37 when the read station needs attention.

Figure 3:
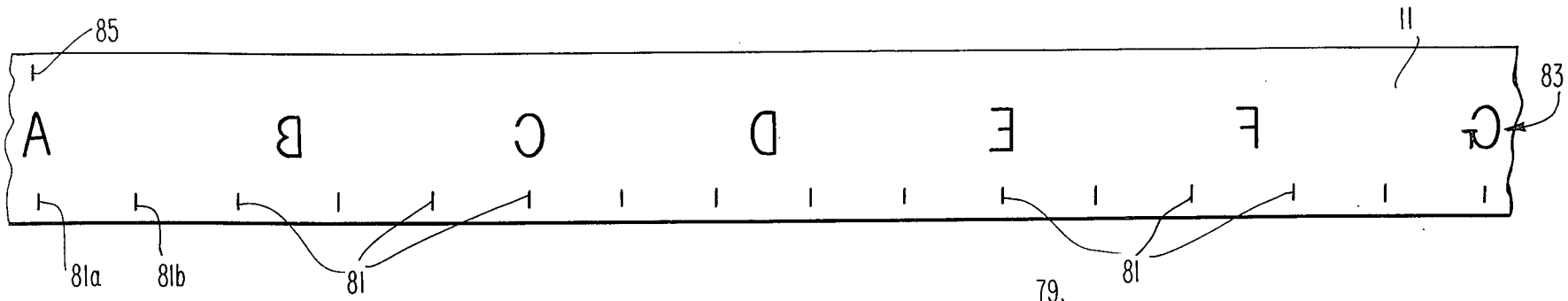
FIG. 3 is an enlarged section of a type band with timing marks thereon.
Figure 2:
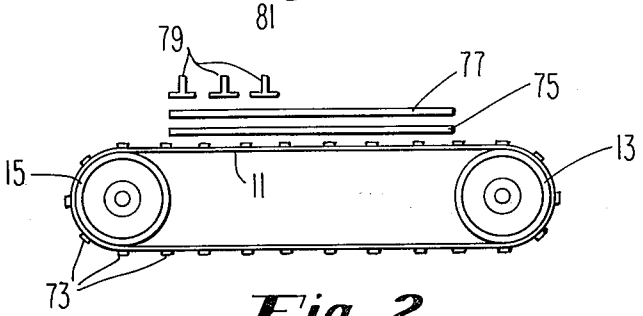
FIG. 2 is a schematic view of a type band mounted on pulleys and shown in its relationship to print hammers, paper to be printed on and an ink ribbon.
Figure 5:
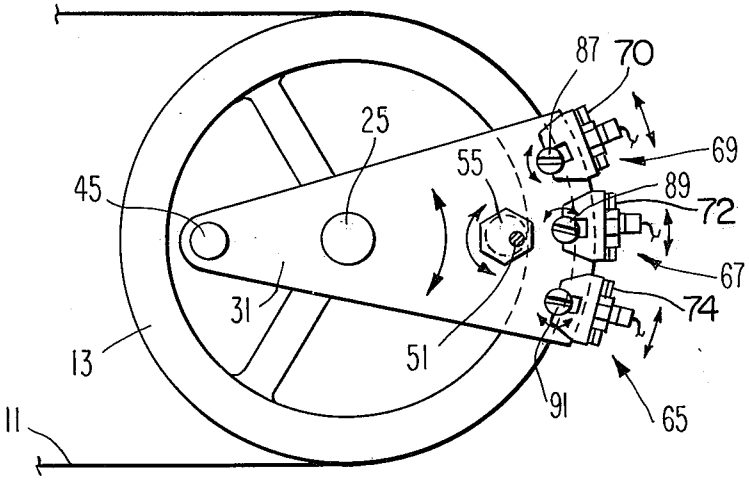
FIG. 5 is a top view of the reading station and adjustment plate.

Before we consider FIG. 5 which shows in detail some of the arrangements of the adjustment apparatus, let us consider FIG. 2 which shows the overall operation of the band printer. In FIG. 2 there are shown two pulleys 13 and 15 about which there is wound a type band 11. On the type band 11 there is shown small protrusions 73 which represent type font that has been formed on the band. It should be understood that there would be many, many more type font than those shown in FIG. 2 and this is only shown for purposes of simply illustration. Also shown in FIG. 2 is an inked ribbon 75 as well as a recording medium 77 which in all likelihood would take the form of a paper report. Further shown in FIG. 2 are three print hammers 79 and again it should be understood that there would be a plurality of print hammers and three are shown merely for purposes of illustration. The manner in which a band printer operates is that the type font which is formed on the type band 11 represents the nature of the image that the user wants printed on the recording medium 77. In short, the type font 73 might be simple alphabetic characters such as shown in FIG. 3. It will be noted in FIG. 3 that the alphabetic characters are the mirror image of the characters that a person would see on a printed report. Returning to FIG. 2 it becomes apparent that as the band 11 moves in a clockwise direction, certain of the type font will be ultimately disposed directly opposite the print hammers 79. If the system is directed to print or transfer the image of the type font onto the recording medium 77 then certain print hammers must be selected when the type font desired is positioned opposite the selected print hammers 79. Particular ones of said print hammers will be selectively actuated to move forward, down toward the bottom of the drawing, gathering enroute the recording medium 77 and the inked ribbon 75 to push them against selected type font so that the ink will be transferred from the ribbon 75 onto the recording medium 77 thereby leaving the image of the font. The type band 11 travels at a very high speed and such printers can print on the order of 3000 lines per minute. It should be understood that on each type band there are many sets of characters. In order words, if a set contains the normal 26 letters of the alphabet plus 10 numerical characters constituting a total of 36 characters there would be a plurality of that number of characters on a type band.

If we consider FIG. 3, we find a small section of a type band on which there is shown seven upper case letters in mirror image form. It should also be noted that there is depicted on the type band 11, in FIG. 3, a plurality of timing marks 81. In the preferred embodiment the distance between the characters that is, for instance, the distance between the letter A and the letter B is 0.25 inches. In the same preferred embodiment the distance between the timing marks 81 is 0.1 inches. Now as can be noted, in FIG. 3, the letter A lies above one of the timing marks 81 while the letter B lies between two of the timing marks 81. The system operates so that all of the odd columns are printed in one time period while all of the even columns are printed in another time period. Accordingly, the system provides two read heads which are spaced a multiple of 0.05 inches apart and which read the timing marks 81. In other words, if we consider FIG. 3 and FIG. 5 and we assume that the read head of read head assembly 67 were to read the timing mark 81*a*, then at a distance 0.05 inches later the read head of read head assembly 65 would read the timing mark 81*a* while the read head of read head assembly 67 would be located between the timing marks 81*a* and 81*b* and therefore would not be detecting any timing mark. In this way, the read heads of read head assemblies 67 and 65 provide timing signals which when properly handled through the appropriate logic circuitry selectively designated, for printing, the proper characters onto or into the appropriate positions of the "printed" report. Now it should be understood that the timing marks 81 shown in FIG. 3 do not provide the signals for the letters 83 shown in FIG. 3 to be printed. In other words, the timing marks on any section of the band are really related to type font which is following at some substantial distance. This becomes apparent if one looks at FIG. 2 and recognizes that the read station is located at the end of the excursion while the type font which is to be printed is riding or being carried along the flat portion of the excursion opposite the print hammers. The timing marks which would control the "printing" of the letters 83 would have preceded those letters and preceded the timing marks shown in FIG. 3.

In FIG. 3 there is also shown an initiating timing mark 85. The initiating timing mark 85 indicates to the system that a new set of type characters is approaching. Again it should be understood that the initiating marking 85 is not meaningful relative to the letters 83 shown in FIG. 3 but is relative to a similar set of letters which is following on the type band and which is in all probability just coming into the flat or straight section of the excursion in front of the type hammers 79 shown in FIG. 2.

Figure 6:
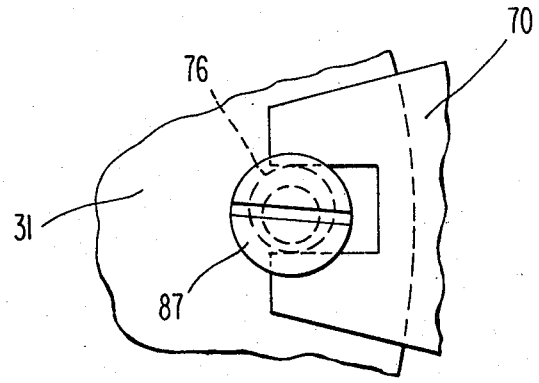
FIG. 6 is an enlarged top view of a portion of the reading station adjustment plate of FIGS. 4 and 5.

It is important that the actuation of the print hammers 79 be accomplished at the proper time. The band 11 is traveling at 270 inches per second and therefore the firing of or actuation of a hammer has to be very precisely done in a timewise consideration. Accordingly, if the read head of read head assemblies 67 and 65 are responsible for detecting the locations of the letters then they must be precisely a multiple of 0.05 inches apart in the preferred embodiment. If should be understood that other relationships (i.e. different from 0.05 inches) between the timing marks can be used and in such cases the read heads would have to be located at precisely those other distances apart. Accordingly, the read head holders 70, 72 and 74 are mounted on the adjustment plate 31 by virtue of mounting screws, such as mounting screw 96 shown in FIG. 4 and located by the eccentric screws 87, 89, and 91. The eccentric screws or cam screws has a cam portion which is located off center, as shown in FIG. 6, and the rotation of the eccentric screws permits the user to rotate the reading head holders, such as holder 70, to a new position. When the mounting screw 96 is loosened, the cam of the cam screw, such as cam 76 shown in FIG. 6, can be rotated and because its cam portion is off-center it moves against the walls of the holder and thereby moves the holder as the cam screw is turned. This action permits the user to move the individual reading heads in a circumferential direction either to the right or to the left so that they are precisely 0.05 inches away from one another. The read head of read head assembly 69 is formed to read the upper initiating mark 85 and it too must accomplish a precise reading. Accordingly read head 69 is located at a precise distance from the read head assembly 67 and is adjusted to the precise distance by its eccentric screw 87.

The gap between the timing marks and the read heads on occasion has to be changed in order to effect the type of signal which is being produced by the read heads and this is accomplished as can be seen in FIG. 4 by loosening the nut 93, relocating the head 95 (which is threaded into the read head holder) with respect to the timing mark 97 and then tightening the nut 93 to maintain the gap.

It becomes apparent when the overall system is considered that a factory or permanent type adjustment can be made with the present structure to enable a precise reading of timing pulses on a type band; to enable the optimum lateral positioning of images being printed; and to obtain the optimum signal output with respect to the gap between the read head and the timing marks on the type band. In addition, it can be readily understood when the overall apparatus is considered that in the event that there is a need to laterally shift the printed images, which necessity may arise from the changing of the thickness of the paper, or which may arise because the operator has not properly located the paper in the tractors, the user can simply shift the entire mechanism by rotating the knob 61 thereby dynamically shifting the printed image while the printing operation is going on. On the other hand, if for some reason due to wear, etc., or due to new forms of type bands there is a necessity to correct the "factory" adjustment, this can be readily accomplished by; the user.

What is claimed is:

1. In a type band cartridge assembly, a location varying magnetic read station means whose location can be varied through coarse and fine adjustments along the rotational path of a rotating endless type band having a plurlaity of groups of type fonts thereon and further having timing indicia thereon located below and above said type fonts, said timing indicia disposed to provide timing signals for printing said type fonts as well as for defining the beginning of said different groups of type fonts and which said endless type band is employed with an impact printer device, said read station comprising in combinataion: a cartridge housing, pulley shafts in said cartridge housing for supporting said endless type band, base plate means having at least one aperture and a well-like structure therein, said aperture formed to fit over a pulley shaft about which said base plate means can be at least partially rotated; at least three magnetic read means formed to read said indicia and disposed so that only one indicium is read at any one time, said read means disposed on said base plate means to be in close proximity with said endless type band as it moves along its rotation path; first eccentric means having an off-center aperture therein formed and disposed to be rotationally engaged within said cartridge housing whereby when said first eccentric means is rotated around said off-center aperture, said base plate means is rotated for a coarse adjustment thereof in response thereto about said at least one aperture; second eccentric means having a shaft with an eccentric shoe member formed integral therewith and knob means for rotating said shaft, said shaft being disposed to fit through said off-center aperture, said shoe member formed and disposed to fit into said well-like structure in said base plate means whereby when said shoe member is moved by said first eccentric means or said knob means of said second eccentric means moving said shoe member, said base plate member is moved thereby enabling alternatively a coarse adjustment or a fine adjustment respectively of the location of said read station along the path lying in close proximity to said path of said rotating endless type band.

2. A location varying magnetic read station means according to claim 1 wherein each of said magnetic read means further comprises a magnetic reluctance sensitive member including gap adjusting means for adjusting the gap between said reluctance sensitive member and said timing indicia on said endless type band.

3. A location varying magnetic read station according to claim 1 wherein there is further included a spring loaded takeup means, and wherein said spring loaded takeup means is disposed to secure said base plate means to said type band cartridge assembly whereby the vertical position of said base plate means and therefore the vertical position of said magnetic read means is held secure.

* * * * *

UNITED STATES PATENT OFFICE

CERTIFICATE OF CORRECTION

PATENT NO. : 3,987,723

DATED : October 26, 1976

INVENTOR(S) : Frank A. Mahoney, Ronald W. F. Hutley

It is certified that error appears in the above-identified patent and that said Letters Patent are hereby corrected as shown below:

It is certified that errors appear in the above identified patent and that said Letters Patent is hereby corrected as shown below.

Column 5, line 56, - Change "head" (first occurrence) to read "heads".

Column 5, line 59, - Change "If" to read "It".

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*